US011672716B2

(12) United States Patent
Newman et al.

(10) Patent No.: US 11,672,716 B2
(45) Date of Patent: Jun. 13, 2023

(54) OVERHEAD LIFT SYSTEMS AND METHODS

(71) Applicant: Liko Research & Development AB, Luleå (SE)

(72) Inventors: Jesse Newman, E. Rochester, NY (US); Christopher Yeckel, Batesville, IN (US); Joseph Tari, Baldwinsville, NY (US); Sravan Mamidi, Batesville, IN (US); Jackie Berkebile, Baldwinsville, NY (US); Jessica Cushman, Cato, NY (US)

(73) Assignee: Liko Research & Development AB, Lulea (SE)

( * ) Notice: Subject to any disclaimer, the term of this patent is extended or adjusted under 35 U.S.C. 154(b) by 107 days.

(21) Appl. No.: 17/161,040

(22) Filed: Jan. 28, 2021

(65) Prior Publication Data

US 2021/0236363 A1 Aug. 5, 2021

Related U.S. Application Data

(60) Provisional application No. 62/968,362, filed on Jan. 31, 2020.

(51) Int. Cl.
*A61G 7/10* (2006.01)

(52) U.S. Cl.
CPC ..... *A61G 7/1015* (2013.01); *A61G 7/1042* (2013.01); *A61G 7/1051* (2013.01);
(Continued)

(58) Field of Classification Search
CPC .. A61G 7/1015; A61G 7/1042; A61G 7/1051; A61G 7/1073; A61G 2203/12; A61G 2203/32; A61G 2203/36
See application file for complete search history.

(56) References Cited

U.S. PATENT DOCUMENTS 5,915,673 A 6/1999 Kazerooni
6,554,252 B2 * 4/2003 Kazerooni ..... B66D 3/18 212/331
(Continued)

FOREIGN PATENT DOCUMENTS

CN 106502415 A 3/2017
CN 105773642 B 12/2017
(Continued)

OTHER PUBLICATIONS

Nero: A Smart Glove That Controls Remove Devices; https://www.hackster.io/nero/nero-a-smart-glove-that-controls-remote-devices-2da104; Published Jul. 27, 2018.

*Primary Examiner* — David R Hare
*Assistant Examiner* — Alexis Felix Lopez
(74) *Attorney, Agent, or Firm* — Dinsmore & Shohl LLP

(57) ABSTRACT

An overhead lift system may include a motor and a lift strap connected to the motor. The motor raises and lowers the lift strap. A hand controller may be communicatively connected to the motor. The hand controller includes a force sensor associated with the body of the hand controller such that force applied to the body is detected with the force sensor. An orientation sensor may also be arranged within the body and determines an orientation of the hand controller. A control unit may be communicatively connected with the motor, the force sensor, and the orientation sensor. The control unit detects a force applied to the hand controller with the force sensor, determines a direction of motion of the hand controller with the orientation sensor, and provides a signal to the motor to raise or lower the lift strap based on the force and orientation of the hand controller.

17 Claims, 14 Drawing Sheets

(52) U.S. Cl.
CPC ..... *A61G 2203/12* (2013.01); *A61G 2203/32* (2013.01); *A61G 2203/36* (2013.01)

(56) References Cited

U.S. PATENT DOCUMENTS

| | | | | | |
|---|---|---|---|---|---|
| 6,622,990 | B2 | 9/2003 | Kazerooni | | |
| 6,668,668 | B1 * | 12/2003 | Peshkin | B66D 3/18 | 73/862.56 |
| 6,681,638 | B2 * | 1/2004 | Kazerooni | B65G 43/00 | 254/270 |
| 6,907,317 | B2 * | 6/2005 | Peshkin | B66D 3/20 | 318/632 |
| 7,071,865 | B2 | 7/2006 | Shibamiya et al. | | |
| 9,104,271 | B1 * | 8/2015 | Adams | G06F 3/014 | |
| 9,971,399 | B2 * | 5/2018 | Lee | G06F 3/011 | |
| 2003/0057408 | A1 * | 3/2003 | Kazerooni | G06F 3/011 | 254/270 |

FOREIGN PATENT DOCUMENTS

| | | | | | |
|---|---|---|---|---|---|
| DE | 102011002952 | A1 * | 7/2012 | B66C 13/40 | |
| DE | 102011002952 | A1 | 7/2012 | | |
| DE | 102013206841 | A1 * | 10/2013 | A61G 7/018 | |
| DE | 102013206841 | A1 | 10/2013 | | |
| DE | 102016004266 | A1 | 10/2017 | | |
| EP | 3622934 | A1 * | 3/2020 | A61G 7/1015 | |
| ES | 2351143 | A1 * | 2/2011 | G06F 3/014 | |
| ES | 2351143 | B1 | 11/2011 | | |
| WO | WO-2012001057 | A1 * | 1/2012 | B25J 9/1633 | |
| WO | WO-2016077920 | A1 * | 5/2016 | A61G 7/1015 | |

* cited by examiner

OVERHEAD LIFT SYSTEMS AND METHODS

The present specification claims the benefit of U.S. Provisional Patent Application Ser. No. 62/968,362 filed Jan. 31, 2020 and entitled "Overhead Lift Systems and Methods," the entirety of which is incorporated by reference herein.

FIELD

The present specification generally relates to overhead lift systems and methods and, more specifically, to overhead lift systems and methods that integrate the movement of the lift system with the handling of a subject with an integrated hand control.

TECHNICAL BACKGROUND

Overhead lift systems that include motive units, such as mobile lifts and/or overhead lifts, may be used in hospitals, health care facilities, and/or home care settings to assist with moving a subject from one location to another and/or to assist with repositioning the subject from one posture to another. Conventional overhead lift systems utilize a sling or other lifting accessory to secure a subject to the overhead lift system and an actuator to lift the subject to a different elevation or lower the subject to a lower elevation. When lifting or moving a subject, a caregiver may handle a controller to operate the overhead lift system, while also steadying the subject. This arrangement, with the caregiver only able to place one or no hands on the subject during a lifting procedure, may lead the subject who is being lifted to feel unsteady.

Accordingly, a need exists for alternative overhead lifting systems and methods which allow a caregiver to operate the overhead lifting systems while simultaneously steadying the subject being lifted.

SUMMARY

According to a first aspect, an overhead lift system, including a motor, a lift strap connected to the motor, the motor operable to raise and lower the lift strap, a hand controller connected to the motor, the hand controller having a front and back surface, a force sensor associated with the body such that force applied to the body is detected with the force sensor, an orientation sensor arranged within the body determining a change in orientation of the hand controller, and a control unit connected with the motor, force sensor, and orientation sensor, and comprising a processor, a memory, and storing a computer readable and executable instruction set which, when executed detects a force applied to the hand controller, determines a direction of motion of the hand controller with the orientation sensor, and provides a control signal to the motor based on the force applied to the hand controller with the detected force sensor and the determined orientation of the hand controller.

According to any of the previous aspects, the orientation sensor may have an accelerometer.

According to any of the previous aspects, the orientation sensor may have a gyroscope.

According to any of the previous aspects, the force sensor may be arranged on a handle secured to the body of the hand controller.

According to any of the previous aspects, the force sensor may be arranged between the body and the handle.

According to any of the previous aspects, the force sensor may be arranged on the front surface of the body.

According to any of the previous aspects, the hand controller may further comprise at least one control button arranged on the front surface of the body, the at least one control button may be communicatively connected to the motor.

According to any of the previous aspects, the at least one control button is deactivated when a force is detected by the force sensor and a change in orientation of the hand controller is determined with the orientation sensor.

According to any of the previous aspects, the overhead lift system may further comprise an activation switch arranged on the hand controller, wherein the activation switch is activated to allow the motor to raise and lower the lift strap.

According to any of the previous aspects, the force sensor may detect a compressive force applied to the hand controller.

According to any of the previous aspects, the force sensor may detect a shear force applied to the hand controller.

According to any of the previous aspects, a speed at which the motor raises or lowers the lift strap is proportional to the force detected by the force sensor.

According to a second aspect, an overhead lift system may include a motor; a lift strap connected to the motor, wherein the motor is operable to raise and lower the lift strap, and a hand controller communicatively connected to the motor. The hand controller may include a body having a front surface and a back surface, a force sensor operatively associated with the body such that force applied to the body is detected with the force sensor, an accelerometer arranged within the body, the accelerometer determining an acceleration of the hand controller and a gyroscope arrange within the body, the gyroscope determining an orientation of the hand controller. The overhead lift system may further comprise a control unit communicatively connected with the motor, force sensor, the accelerometer, and the gyroscope. The control unit may include a processor and a memory storing a computer readable and executable instruction set which, when executed by the processor: detects a force applied to the hand controller with the force sensor; determines an acceleration of the hand controller with the accelerometer; determines an orientation of the hand controller with the gyroscope; and provides a control signal to the motor to either raise or lower the lift strap based on the detected force, the determined acceleration, and the determined orientation of the hand controller.

According to any of the previous aspects, the overhead lift system may further comprise a mounting clip arranged on the distal end of the lift strap, the mounting clip comprising a first securement interface; a second securement interface on at least one of the front surface and the back surface, wherein the second securement interface is arranged to couple with the first securement interface in a secured orientation position; and a coupling sensor operatively associated with at least one of the first securement interface and the second securement interface. The computer readable and executable instruction set, when executed by the processor may: detect the first securement interface coupled to the second securement interface in the secured orientation position with the coupling sensor; detect a force applied to the hand controller with the force sensor; determine an acceleration of the hand controller with the accelerometer; and provide a control signal to the motor to either raise or lower the lift strap based on the force detected with the force sensor and the determined acceleration of the hand controller when the first securement interface is coupled to the second securement interface as detected by the coupling sensor.

According to any of the previous aspects, the force sensor may detect a shear force applied to the hand controller.

According to any of the previous aspects, the force sensor may be operatively arranged on the back surface of the hand controller.

According to any of the previous aspects, the overhead lift system may further comprise a handle arranged on the back surface of the hand controller.

According to any of the previous aspects, the force sensor may be operatively arranged on the handle of the hand controller.

According to any of the previous aspects, a speed at which the motor raises or lowers the lift strap is proportional to the force detected by the force sensor.

According to a third aspect, an overhead lift system may include a motor, a lift strap connected to the motor, where the motor is operable to raise or lower the lift strap, a mounting clip may be arranged on the distal end of the lift strap, the mounting clip may include a first securement interface. A hand controller may be communicatively connected to the motor and may include a body having a front surface and a back surface, a second securement interface, where the second securement interface may be arranged to couple with the first securement interface in a secured orientation position, and a force sensor may be operatively associated with the body such that force applied to the body may be detected with the force sensor. A coupling sensor may be operatively associated with at least one of the first securement interface and the second securement interface. A control unit may be communicatively connected with the motor, force sensor, coupling sensor, and orientation sensor, and may include a processor and a memory storing computer readable and executable instruction set which, when executed by the processor may detect the first securement interface coupled to the second securement interface in the secured orientation position with the coupling sensor, may detect a force applied to the lift strap with the force sensor, and may provide a control signal to the motor to either raise or lower the lift strap based on the force applied to the lift strap when the first securement interface is coupled to the second securement interface as detected by the coupling sensor.

According to any of the previous aspects, a speed at which the motor raises or lowers the lift strap is proportional to the force detected by the force sensor.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments of lift systems and methods and is intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
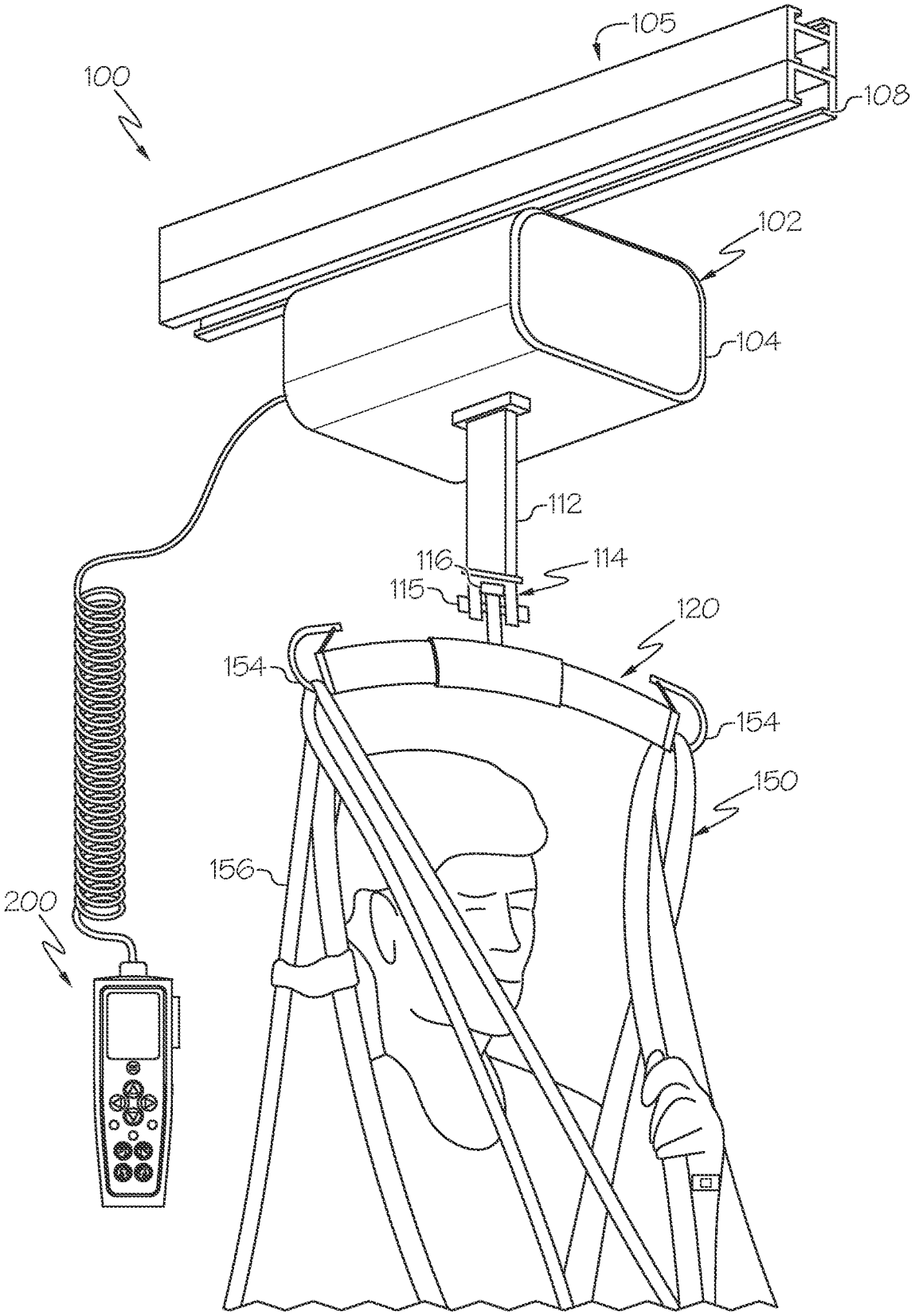
FIG. 1 schematically depicts a subject seated in a lifting accessory and suspended from an overhead lift system according to one or more embodiments shown or described herein.

Reference will now be made in detail to embodiments of overhead lift systems and methods of operating the same, examples of which are illustrated in the accompanying drawings. Whenever possible, the same reference numerals will be used throughout the drawings to refer to the same or like parts. In embodiments, an overhead lift system may include a motor and a lift strap connected to the motor. The motor raises and lowers the lift strap. A hand controller may be communicatively connected to the motor. The hand controller includes a force sensor associated with the body of the hand controller such that force applied to the body is detected with the force sensor. An orientation sensor may also be arranged within the body and determines an orientation of the hand controller. A control unit may be communicatively connected with the motor, the force sensor, and the orientation sensor. The control unit detects a force applied to the hand controller with the force sensor, determines a direction of motion of the hand controller with the orientation sensor, and provides a signal to the motor to raise or lower the lift strap based on the force and orientation of the hand controller. Various embodiments of overhead lift systems and methods for operating the same will be described herein with specific reference to the appended drawings.

Overhead lift systems are typically deployed in subject care environments. Overhead lift systems allow caregivers to reposition subjects while minimizing exertion of the caregiver. However, during a lifting procedure, a subject may feel uneasy as they are freely suspended from the overhead lift system. More particularly, even though the subject is secured within a sling and is not in danger of falling, the subject may experience the sensation of falling as they are freely suspended. This may make the subject feel unsafe as a caregiver attempts to move the subject. In order to steady the subject and help put the subject at ease, a caregiver may steady the subject with one or both hands during the lift. However, simultaneously operating the hand controller of the lift while steadying the subject with both hands may be difficult or even impossible for the caregiver.

Embodiments according to the present disclosure include components that allow the caregiver to control the overhead lift system by applying pressure on a hand controller or other elements of the overhead lift system such as a strap. This may be accomplished by, for example, gently pressing the hand controller against the subject. This may provide a caregiver with the ability to place both hands on the subject during a lifting procedure while still operating the hand controller. In some embodiments, the caregiver may apply a compressive force to the hand controller to operate the lift. In some embodiments, the caregiver may apply a shear force to the hand controller to operate the lift. In some embodiments, the overhead lift system may require the caregiver to contact a portion of the overhead lift system in order to operate the lift. The embodiments of overhead lift systems described herein allow a caregiver to steady a subject during a lift while simultaneously controlling the overhead lift system.

Referring now to FIG. 1, an embodiment of an overhead lift system 100 is schematically depicted. The overhead lift system 100 generally includes an overhead lift unit 102 comprising a motor 103 (not depicted in FIG. 1; schematically depicted as motor 103 in FIG. 4) situated in a housing 104 of the overhead lift unit 102, and a lift strap 112 coupled to the motor. A sling bar 120 may be coupled to the overhead lift unit 102 via the lift strap 112 and a lifting accessory 150. The lifting accessory 150 may be, for example and without limitation, a sling, lift vest, or lifting sheet removably coupled to the sling bar 120.

In the depicted embodiment, the overhead lift unit 102 is affixed to a ceiling of a room or other overhead structure. For example, the ceiling of the room may include a rail 105 to which the overhead lift unit 102 is affixed. The rail 105 may comprise a channel 108 within which is provided a carriage (not depicted) that is movable along the channel 108 and supports the overhead lift unit 102 in the rail 105. In embodiments, the rail 105 may be affixed to and supported by structural elements of the building or other structure in which the rail 105 is located.

A lift strap 112 may be connected at a first end (not depicted) to the motor of the overhead lift unit 102 and configured to be taken up or paid out from the overhead lift unit 102 with the motor. A quick-release link 114 may be coupled to a free second end of the lift strap 112, and the sling bar 120 may be removably coupled to the quick-release link 114 by a fastener 115. In embodiments, a sensor 116 may be arranged on quick-release link 114 and communicatively coupled with an electronic control unit 250 (shown in FIG. 4) of the overhead lift system 100. In embodiments, the sensor 116 is a hook switch that determines if the quick-release link 114 and fastener 115 are properly oriented and secured to one another. If the sensor 116 does not determine that the quick-release link 114 and the fastener 115 are properly oriented and secured, an indicator may be activated by the electronic control unit 250 providing an alert to a caregiver of an improper connection between the sling bar 120 and the lift strap 112. In embodiments, the electronic control unit 250 may prevent actuation of the overhead lift unit 102 when an improper connection between the sling bar 120 and the lift strap 112 is detected.

The overhead lift unit 102 may receive inputs from a caregiver via hand controller 200 that is communicatively coupled to the overhead lift unit 102. The hand controller 200 may include a wired controller and/or one or more wireless controllers. For example, in embodiments, the hand controller 200 may be a wired controller (such as a pendant or the like) as depicted in FIG. 1 or, alternatively, a controller integrated into the overhead lift unit 102. The hand controller 200 may pass control signals to the overhead lift unit 102 and, more particularly, to the motor of the overhead lift unit 102 arranged within the housing 104 of the overhead lift unit 102. Based on the input received from the hand controller 200, the overhead lift unit 102 may selectively pay out or take up the lift strap 112.

As depicted in FIG. 1, the lifting accessory 150 is coupled to the lift strap 112 with a sling bar 120. The lifting accessory 150 is used to support a subject on the overhead lift unit 102. In various embodiments, the lifting accessory 150 may include a lifting sling, a lifting vest, a lifting strap, a lifting sheet, or the like. The weight of a subject positioned in the lifting accessory 150 is born by the sling bar 120 and, in turn, the lift strap 112 and the overhead lift unit 102 as a result of the lifting accessory 150 being suspended from the sling bar 120. In the embodiment depicted in FIG. 1, the lifting accessory 150 includes a plurality of strap members 156 that are configured to support a subject in the lifting accessory 150 in a particular posture. The lifting accessory 150 is removably coupled to lifting hooks 154 of the sling bar 120 with the strap members 156.

Figure 2:
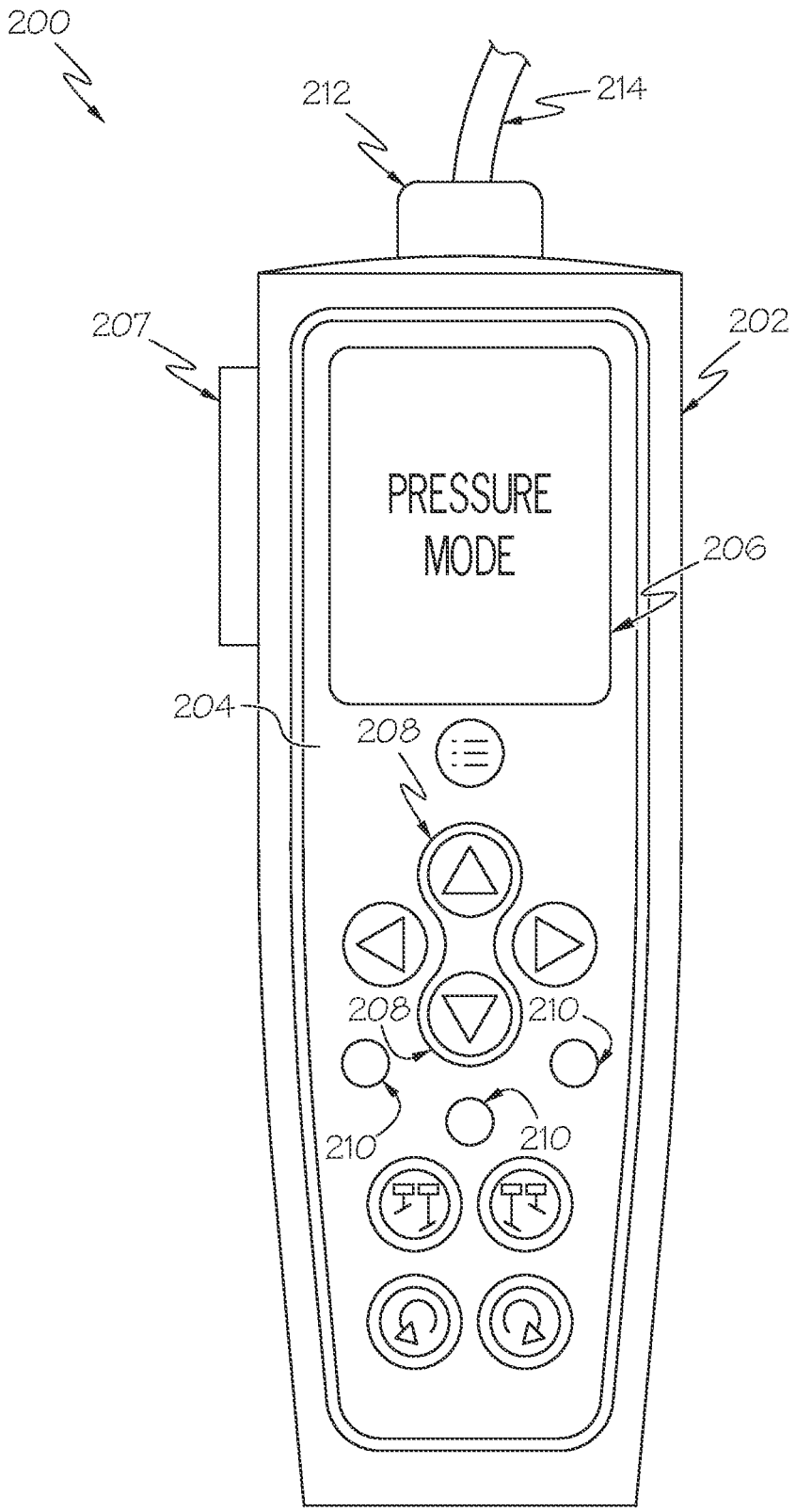
FIG. 2 schematically depicts a hand controller for an overhead lift system according to one or more embodiments shown or described herein.
Figure 3:
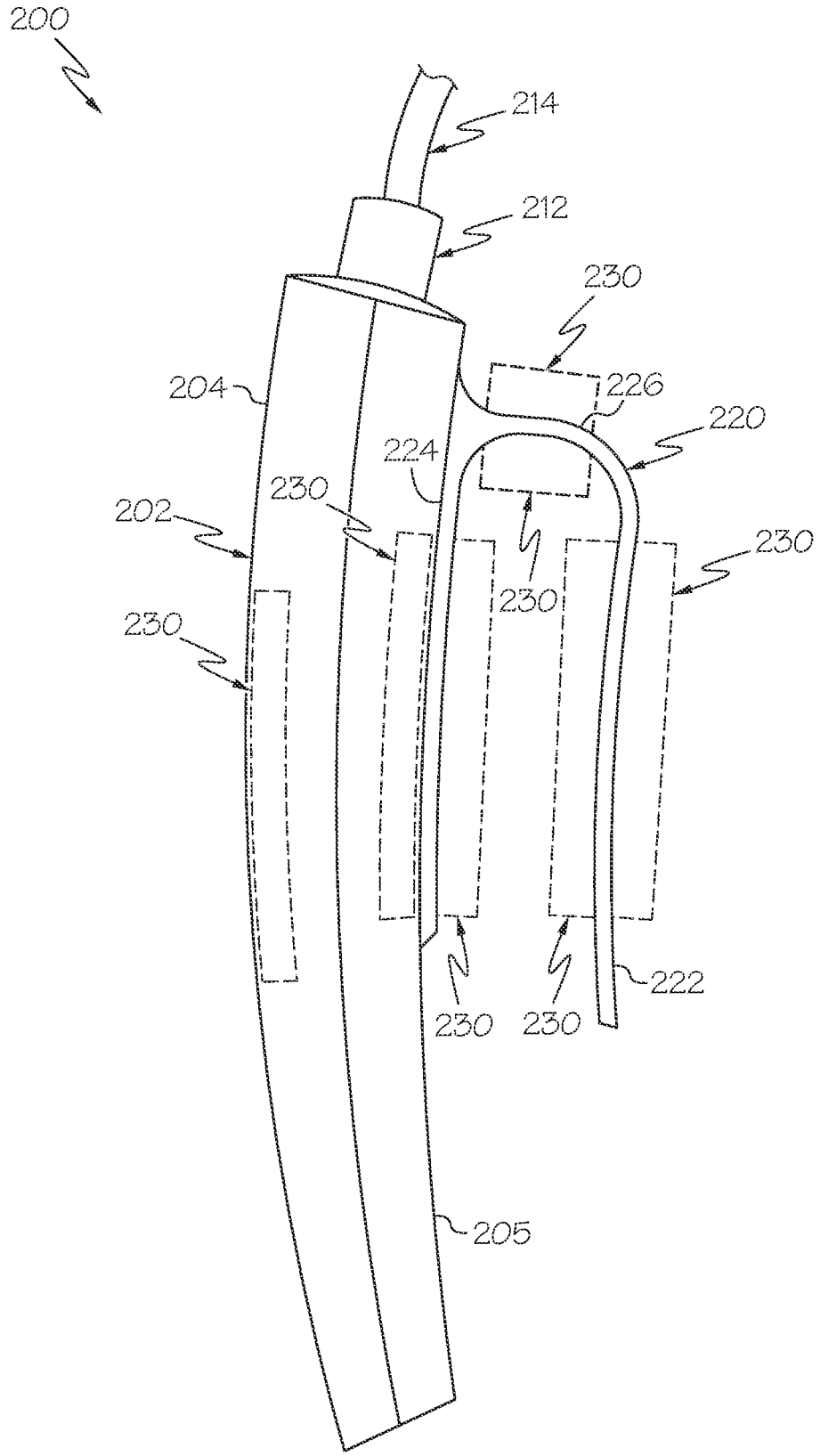
FIG. 3 schematically depicts a side view of a hand controller for an overhead lift system according to one or more embodiments shown or described herein.
Figure 4:
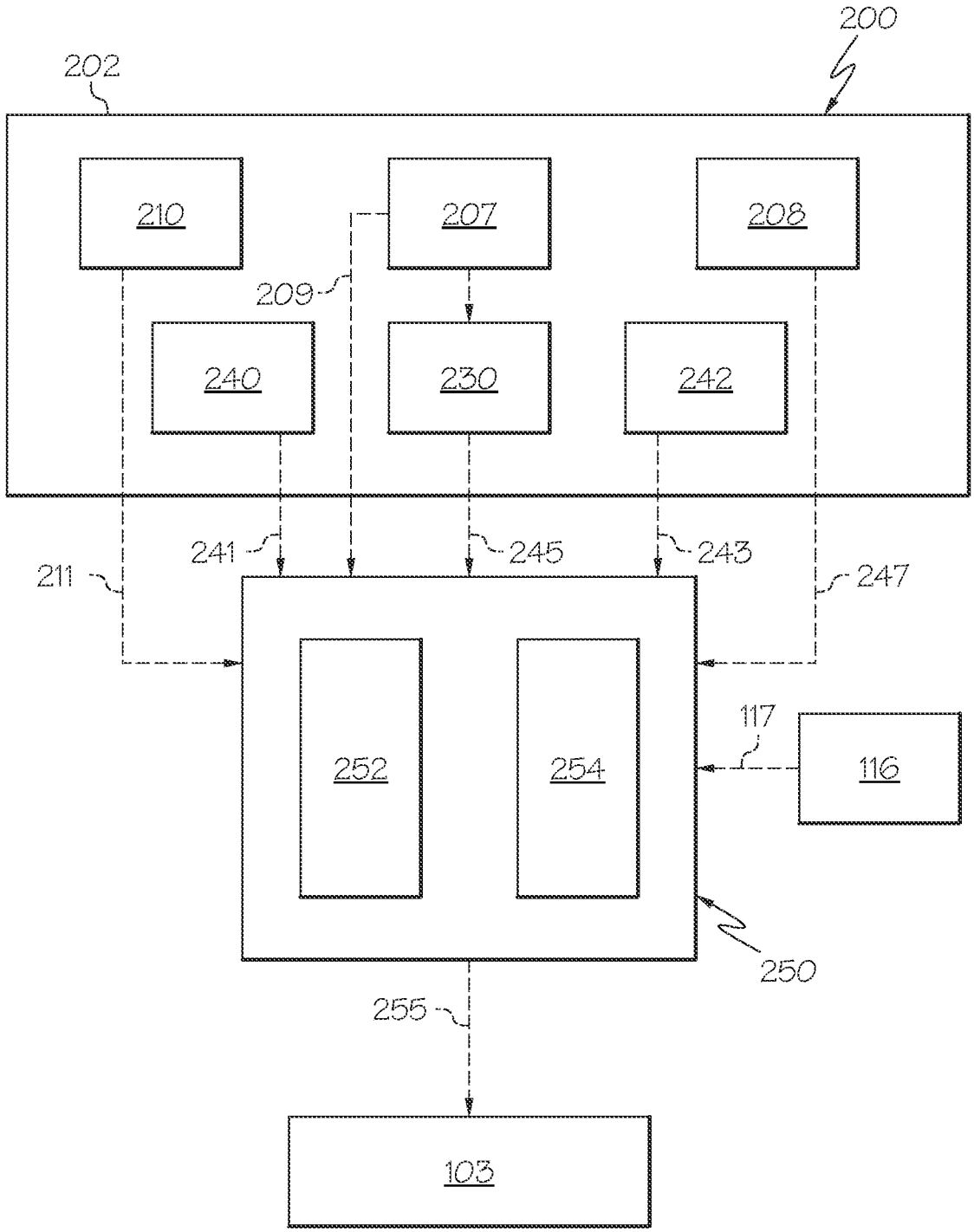
FIG. 4 is a block diagram of illustrative internal components of the hand controller and overhead lift system according to one or more embodiments shown or described herein.

Referring now to FIGS. 2 and 4, a control unit 250 of the overhead lift unit 102 receives user inputs from hand controller 200, as described herein. In embodiments, the control unit 250 of the overhead lift unit 102 may be disposed in, for example and without limitation, the housing 104 (FIG. 1) of the overhead lift unit 102. Hand controller 200 generally includes a body 202, front surface 204, and back surface 205 (shown in FIG. 3). In embodiments the hand controller 200 may optionally comprise a screen 206. In embodiments in which the hand controller 200 is a wired controller 200, the hand controller may further comprise a communication cable 214 coupled to the hand controller 200 through port 212. The communication cable 214 communicatively couples the hand controller 200 to the motor 103 (FIG. 4) of the overhead lift unit 102 through the control unit 250. Input buttons 208 are arranged on the front surface 204 of body 202 of the hand controller 200 and allow a caregiver to operate the overhead lift system 100 in a conventional manner, by using the buttons to provide control signals 247 to the control unit 250 of the overhead lift unit 102 thereby causing the motor 103 of the overhead lift unit 102 to pay out or take up the lift strap 112. Input buttons 208 may be disposed in the front surface 204 of the hand controller 200 and hermetically sealed to prevent contamination a facilitate cleaning with damaging electrically components within the hand controller 200. Even though input buttons 208 are represented in FIG. 2 as directional buttons arranged on front surface 204, it should be appreciated that input buttons can be arranged on any portion of the body 202 of the hand controller 200. In addition, screen 206 (when provided) may display a variety of different messages to a caregiver during operation of the overhead lift system 100. Additionally or alternatively, the screen 206 may comprise touch functionality such that the screen 206 may be used as an input device. When a caregiver presses input buttons 208, control signals 247 are transmitted to the control unit 250 (depicted in FIG. 4) of the overhead lift unit 102, which in turn transmits a signal to the motor 103 of the overhead lift unit 102 to either raise or lower the lift strap 112.

In some embodiments, hand controller 200 may further comprise a button 207 arranged on the body 202 of the hand controller 200. Button 207 may be used to activate a pressure mode of the hand controller 200, as will be described in further detail herein. The placement of button 207 is such that when a caregiver is holding hand controller 200 in their hand and is intending to use hand controller 200 in a pressure mode, button 207 can be pressed by the caregiver. Button 207 serves as both an input to the overhead lift unit 102 indicating that a caregiver intends to operate the overhead lift system 100 in a pressure mode, and to ensure an unintended lift does not occur unless the hand controller 200 is firmly within a caregiver's hand in the correct orientation. In embodiments, button 207, when actuated by a user, may also prevent the buttons 208 from providing control signals to the control unit 250 of the overhead lift unit 102. It should be appreciated, however, that other mechanisms can be used to determine if a caregiver is holding the hand controller 200 in the correct orientation and intends to use the hand controller 200 in a pressure mode. Examples of button 207 may include a photodetector to determine if a hand is covering the area of button 207, or a simple mechanical switch.

In some embodiments, hand controller 200 includes a securement interface 210. The securement interface 210 is arranged to physically couple or physically and communicatively couple with a corresponding securement interface 118 arranged on a quick-release link 114 (shown in FIG. 11) associated with the lift strap 112, as will be described in further detail herein. The securement interface 210 may be arranged on the front surface 204 of the body 202 of the hand controller 200. However, it should be understood that other locations for the securement interface 210 are contemplated and possible, such as on the back surface 205 of the hand controller 200 or the like. As described herein, the securement interface 210 engages with the securement interface 118 arranged on the quick-release link 114 (FIG. 11) associated with the lift strap. In embodiments, when the securement interface 210 is properly secured to securement interface 118 in a secured orientation position, a signal 211 is transmitted to control unit 250 to allow a specific mode of operation of the overhead lift unit 102, as will be described in further detail herein.

Still referring to FIG. 2, port 212 is communicatively coupled to the electrical components (depicted in FIG. 4) arranged within the body 202 of the hand controller 200, and facilitates transmitting inputs from the hand controller 200 to the control unit 250 of the overhead lift unit 102. These inputs are transmitted from the hand controller 200 through the port 212 and cable 214 to the control unit 250 of the overhead lift unit 102. In embodiments, signal inputs from hand controller 200 may be transmitted to the control unit 250 of the overhead lift unit 102 using a wireless connection such as Bluetooth or Wi-Fi connectivity, for example.

Figure 7:
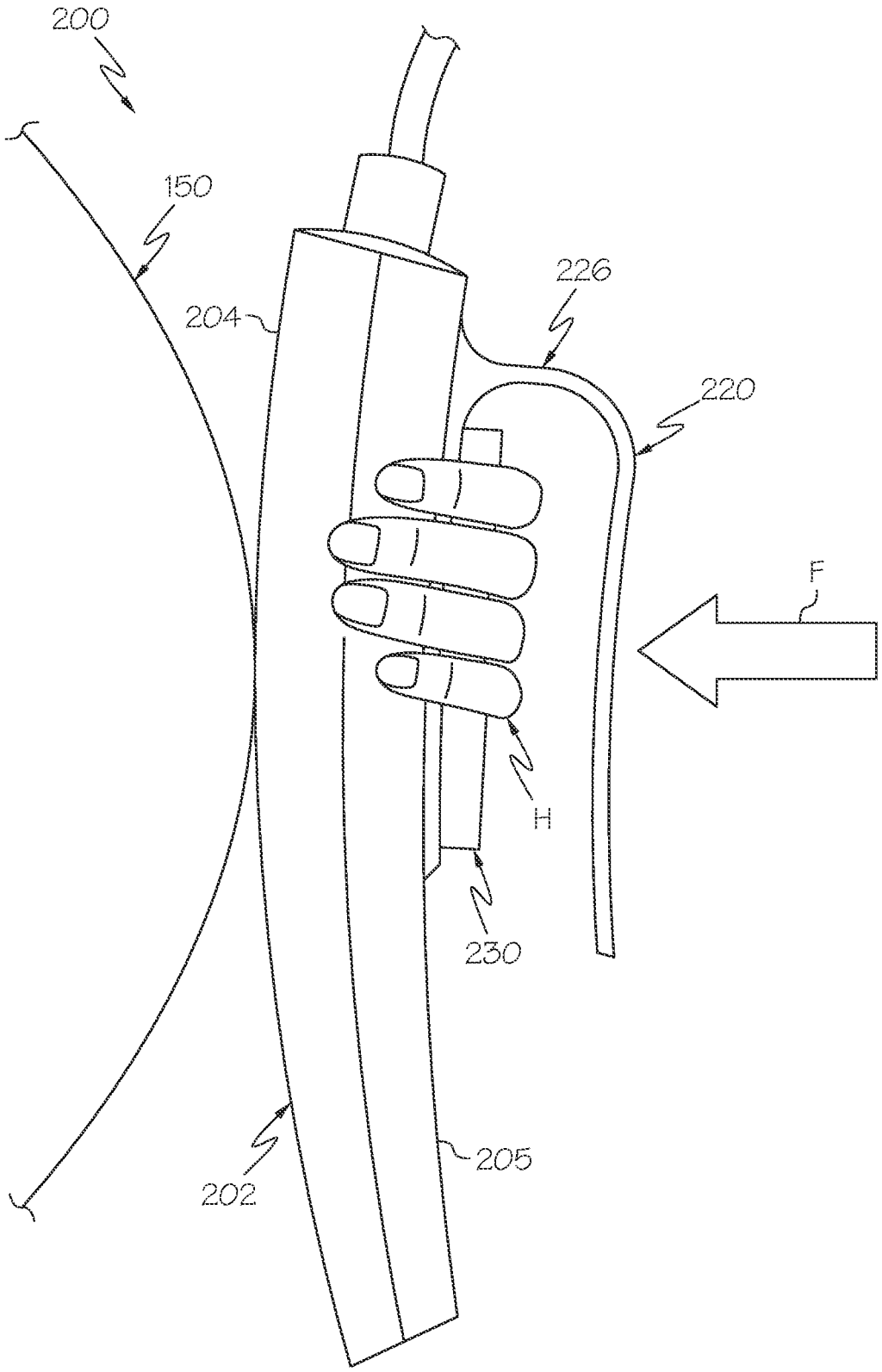
FIG. 7 schematically depicts a side view of a hand controller for an overhead lift system according to one or more embodiments shown or described herein.

Referring now to FIG. 3, the hand controller 200 further includes a handle 220 arranged on the back surface 205 of the body 202. The handle 220 includes a clip portion 222, mounting portion 224, and extension portion 226. The mounting portion 224 is arranged to secure the handle 220 to the back surface 205 of the body 202. The extension portion 226 is integral with the mounting portion 224 and extends outwardly from the back surface 205 of the body 202. The clip portion 222 is integral with the extension portion 226 and may extend substantially parallel to the back surface 205 and mounting portion 224, as depicted in FIG. 3. However, it should be understood that other embodiments are contemplated and possible, such as embodiments in which the clip portion 222 is non-parallel with the back surface 205 of the body 202 and non-parallel with the mounting portion 224. When a caregiver is using hand controller 200, the caregiver's hand may rest within the space formed within the handle 220 between the clip portion 222, the mounting portion 224, and the extension portion 226, as schematically depicted in FIG. 7.

Referring now to FIGS. 3 and 4, in the embodiments described herein, one or more force sensors 230 may be arranged in various locations on the hand controller 200. In FIG. 3 a plurality of force sensors 230 are depicted in dashed lines to generally indicate possible locations of the force sensors 230 with respect to the hand controller 200. Suitable locations for the force sensors 230 include, without limitation, on either side of the clip portion 222 of the handle 220, on either side of the mounting portion 224 of the handle 220 (i.e., between the mounting portion 224 and the back surface 205 of the body 202 or between the mounting portion 224 and the clip portion 222), and/or on either side of the extension portion 226 of the handle 220. Additionally or alternatively, force sensors 230 may be arranged within the body 202 underneath the front surface 204 of the body 202 or underneath the back surface 205 of the body 202. In embodiments, the force sensors may be configured to detect compressive forces and/or shear forces applied to the body 202 and/or handle 220 of the hand controller 200. The force sensors 230 may be, for example and without limitation, piezo-electric force sensors, micro electrical-mechanical system (MEMS) sensors, force-sensitive resistors, or the like. The force sensors 230 output a signal 245 to the control unit 250 of the overhead lift unit 102 indicative of compressive forces and/or shear forces applied to the body 202 and/or handle 220 of the hand controller 200.

Still referring to FIGS. 3 and 4, hand controller 200 may further include one or more orientation sensors for determining the orientation of the hand controller 200. In embodiments, an orientation sensor can be a gyroscope 240, an accelerometer 242, or a combination of both a gyroscope and an accelerometer. For example, in embodiments, the hand controller 200 may include a gyroscope 240 and accelerometer 242 arranged within the body 202 of the hand controller 200. The gyroscope 240 outputs signal 241 to the control unit 250 of the overhead lift unit 102 indicative of the orientation of the hand controller 200. Similarly, accelerometer 242 is arranged within the body 202 of the hand controller 200 and outputs signal 243 to the control unit 250 of the overhead lift unit 102 indicative of the acceleration of the hand controller 200.

Referring now to FIG. 4, the control unit 250 of the overhead lift unit 102 includes a processor 252 and a non-transitory memory 254. A computer readable and executable instruction set may be stored in the non-transitory memory 254 and executed by the processor 252 to operate the overhead lift unit 102. For example, signals 247 received from the hand controller 200 when buttons 208 on the hand controller 200 are pressed may cause the processor 252 of the control unit 250 to actuate the motor 103 to pay-out or take-up the lift strap 112.

In embodiments, signals 209 from the button 207 may cause the processor 252 of the control unit 250 to place the overhead lift unit in a pressure mode in which signals from the one or more force sensors 230, the gyroscope 240, and the accelerometer 242 are used by the control unit 250 to either pay-out or take-up the lift strap 112 with the motor 103. For example, when the pressure mode is activated by actuating button 207 and a signal 245 indicative of a force on the hand controller 200 is received by the control unit 250, signal 241 from the gyroscope 240 and signal 243 from accelerometer 242 of the hand controller 200 may cause the control unit 250 to determine the orientation of the hand controller 200 and the acceleration of the hand controller 200, and based on these signals, the direction of intended travel of the lift strap 112 (i.e., up or down) when a force is applied to the hand controller 200. Specifically, a signal 245 from the force sensor 230 may cause the processor 252 of the control unit 250 to determine that the caregiver is attempting to either raise or lower a subject. The processor of the control unit 250 may then use the orientation of the hand controller 200, as determined from the signal 241 from the gyroscope 240, and the acceleration of the hand controller 200, as determined from the signal 243 from the accelerometer 242, to determine the direction of intended travel of the lift strap 112 (i.e., up or down). After the direction of intended travel of the lift strap 112 is determined by processor 252, the processor 252 outputs a signal 255 to the motor 103 of the overhead lift unit 102 to either raise or lower lift strap 112.

In embodiments, the processor 252 may also determine the magnitude of the force applied to the hand controller 200 based on the signal 245 from the force sensor 230. The magnitude of the force applied to the hand controller 200 is indicative of the intended rate of raising or lowering the subject. That is, the signal 245 from the force sensor 230 may be proportional to the speed by which the motor 103 of the overhead lift unit 102 pays-out or takes-up the lift strap 112. For example, if a large amount of force is applied to the force sensor 230 through the hand controller 200, the motor 103 of the overhead lift unit 102 raises or lowers the lift strap 112 at a faster speed than if a smaller force was applied to force sensor 230 through the hand controller 200. In these embodiments, the processor 252 adjust the signal 255 transmitted to the motor 103 to either increase or decrease the rate at which the lift strap is paid-out or taken-up based on the magnitude of the force applied to the hand controller 200.

In some embodiments, a signal 211 from the securement interface 210 may allow the control unit 250 to determine in which mode of operation the caregiver plans to use the overhead lift system 100, and that the hand controller 200 is secured to the securement interface 118. For example and without limitation, a signal 245 from the force sensor 230 may allow the control unit 250 to determine that the caregiver is attempting to either raise or lower a subject, and the magnitude of the force may be correspond to the intended speed of travel of the motor 103 of the overhead lift unit 102. A signal 117 from the sensor 116 may allow the control unit 250 to determine that the sling bar 120 is properly secured to the lift strap 112. In embodiments, the control unit 250 executes the computer readable and executable instruction set and determines if a caregiver is attempting to lower or raise lift strap 112 after confirming that the securement interfaces 118 and 210 are connected, thereby determining the orientation of the hand controller 200. The control unit 250 then determines the amount and direction of force applied to the force sensor(s) 230 of the hand controller 200 and operates the lift to either lower or raise the lift strap 112 based on this information.

Referring now to FIGS. 4-7 for further illustration, in embodiments, a subject is placed in a lifting accessory 150 which is secured to the lift hooks 154 of the sling bar 120 via strap members 156. With the subject secured within lifting accessory 150, a caregiver may use the hand controller 200 in a compressive pressure mode to control the overhead lift unit 102 to raise and/or lower the subject. To facilitate raising or lowering the subject in the pressure mode, a caregiver first positions their hand H within the space formed by handle 220 such that their hand H arranged over force sensor 230, as depicted in FIG. 7. The caregiver then presses button 207 arranged on body 202 of hand controller 200. Activation of button 207 deactivates the input buttons 208 arranged on the front surface 204 of the hand controller 200 to prevent contradicting signals from being sent to the control unit 250 (FIG. 4) of the overhead lift unit 102 if input buttons 208 were inadvertently pressed during operation of the overhead lift system 100 in a pressure mode.

Figure 5:
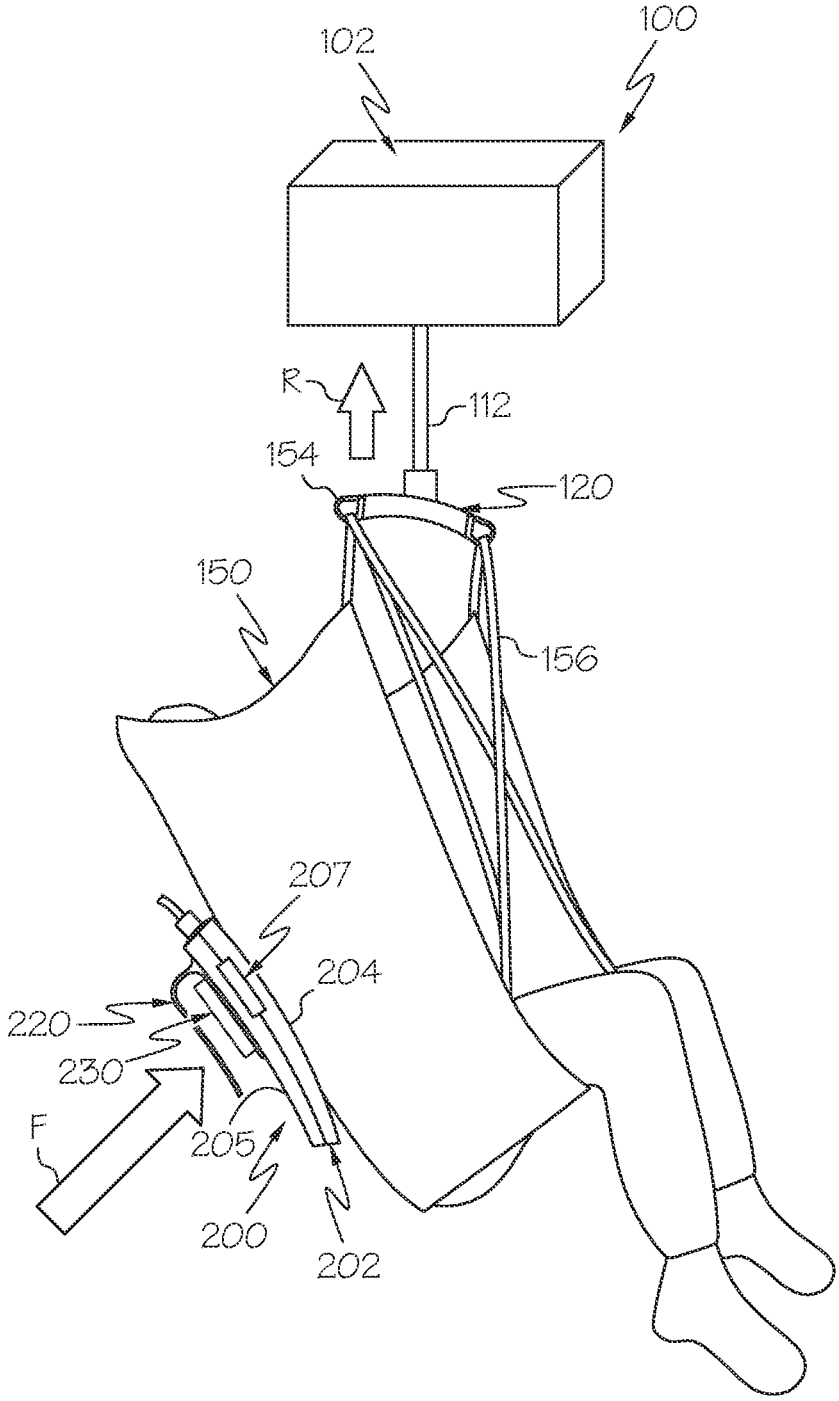
FIG. 5 schematically depicts a side perspective view of a subject seated in a lifting accessory and suspended from an overhead lift system according to one or more embodiments shown or described herein.

With button 207 pressed, the caregiver contacts (i.e., touches) the subject in the lift sling with, for example, the front surface 204 of the hand controller 200, as depicted in FIG. 5. Contacting the subject with the front surface 204 of the hand controller 200 while the caregiver's hand H is positioned in the handle 220 causes a compressive force F to be applied to the force sensor 230 and the body 202 of the hand controller 200. A signal indicative of the compressive force registered by the force sensor 230 is sent to the control unit 250 of the overhead lift unit 102 along with signals indicative of the orientation and acceleration of the hand controller 200. The control unit 250 of the overhead lift unit 102 then activates the motor 103 to either pay out or take up the lift strap 112 based on the detected force and the orientation of the hand controller 200, thereby raising or lowering the subject. The control unit 250 of the overhead lift unit 102 deactivates the motor 103 once a caregiver ceases to apply the force F to the subject with the front surface of the hand controller 200.

As shown in FIG. 5, if the primary component of the force F is applied to the subject in an upward direction, the lift strap 112 will be taken-up by the motor 103 of the overhead lift unit 102, and the subject will be raised in direction indicated by arrow R. As described herein, the direction of the force F is determined by the orientation of the hand controller 200 as indicate from either the gyroscope 240, the accelerometer 242, or both. For example, the gyroscope 240 and the accelerometer 242 may allow the control unit 250 of overhead lift unit 102 to determine the orientation of the hand controller 200 with respect to vertical and/or horizontal and the direction the hand controller is moving due to the force F applied by the caregiver. Based on this information, the control unit 250 of the overhead lift unit 102 determines that the force F applied to the hand controller 200, in combination with the orientation of the hand controller 200, is indicative of a caregiver attempting to lift the subject thereby requiring that the motor 103 of the overhead lift unit 102 be activated to take-up the lift strap 112 in the direction indicated by arrow R.

Figure 6:
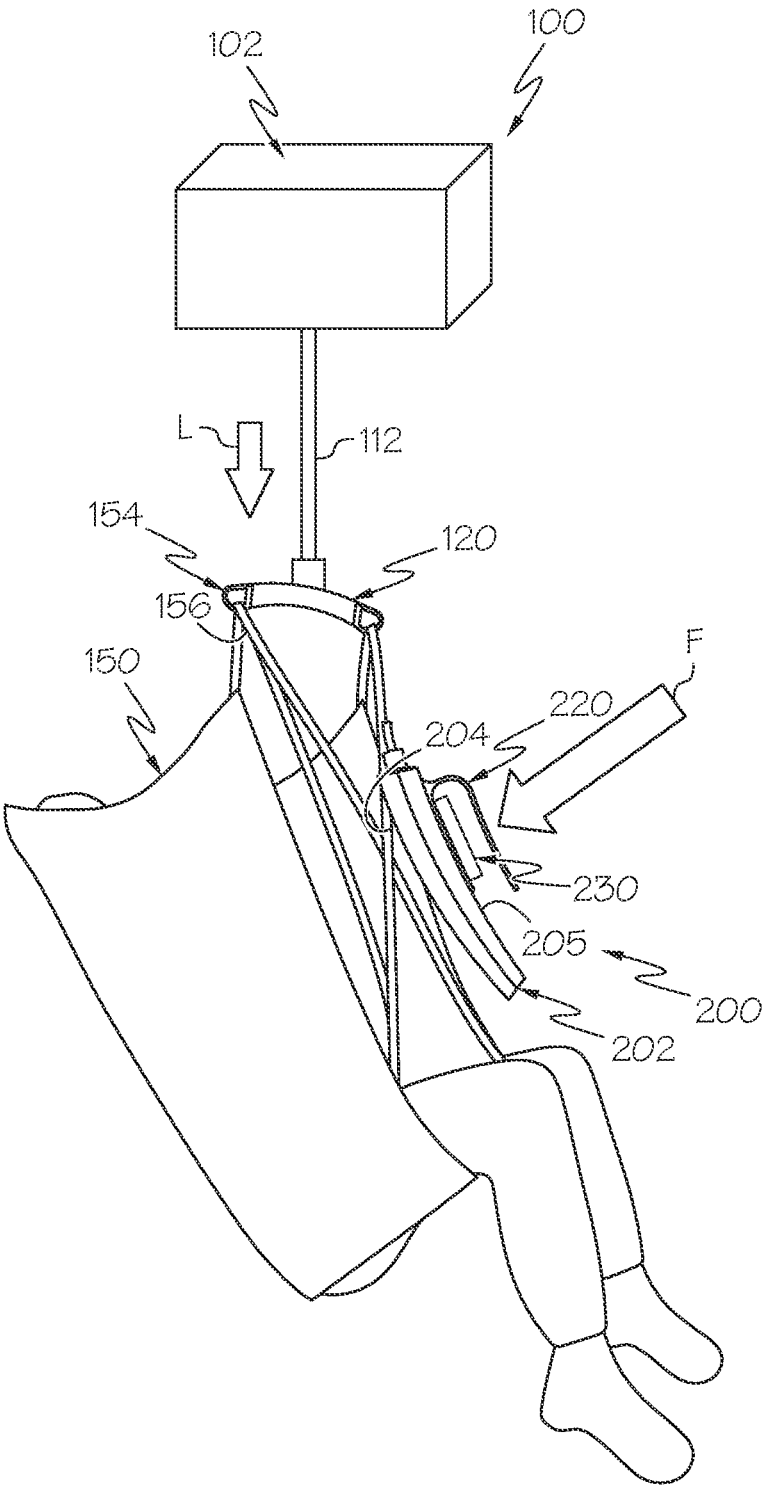
FIG. 6 schematically depicts a side perspective view of a subject seated in a lifting accessory and suspended from an overhead lift system according to one or more embodiments shown or described herein.

As shown in FIG. 6, if the primary component of the force F is applied to the subject in downward direction, the lift strap 112 will be paid-out by the motor 103 of the overhead lift unit 102, and the subject will be lowered in direction indicated by arrow L. As described herein, the direction of the force F is determined by the orientation of the hand controller 200 as indicate from either the gyroscope 240, the accelerometer 242, or both. For example, the gyroscope 240 and the accelerometer 242 may allow the control unit 250 of overhead lift unit 102 to determine the orientation of the hand controller 200 with respect to vertical and/or horizontal and the direction the hand controller is moving due to the force F applied by the caregiver. Based on this information, the control unit 250 of the overhead lift unit 102 determines that the force F applied to the hand controller 200, in combination with the orientation of the hand controller 200, is indicative of a caregiver attempting to lower the subject thereby requiring that the motor 103 of the overhead lift unit 102 be activated to pay-out the lift strap 112 in the direction indicated by arrow L.

Figure 8:
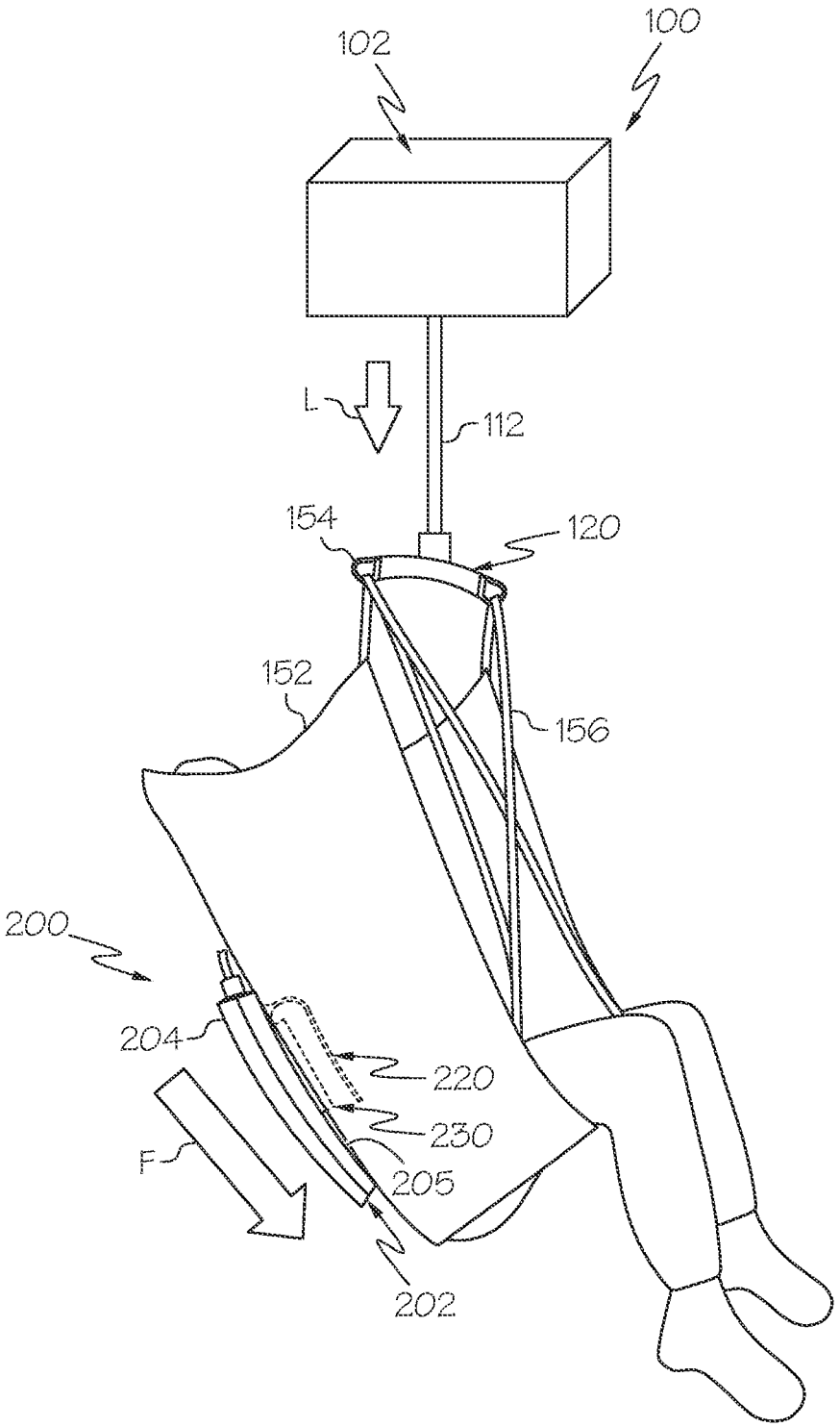
FIG. 8 schematically depicts a side perspective view of a subject seated in a lifting accessory and suspended from an overhead lift system according to one or more embodiments shown or described herein.
Figure 9:
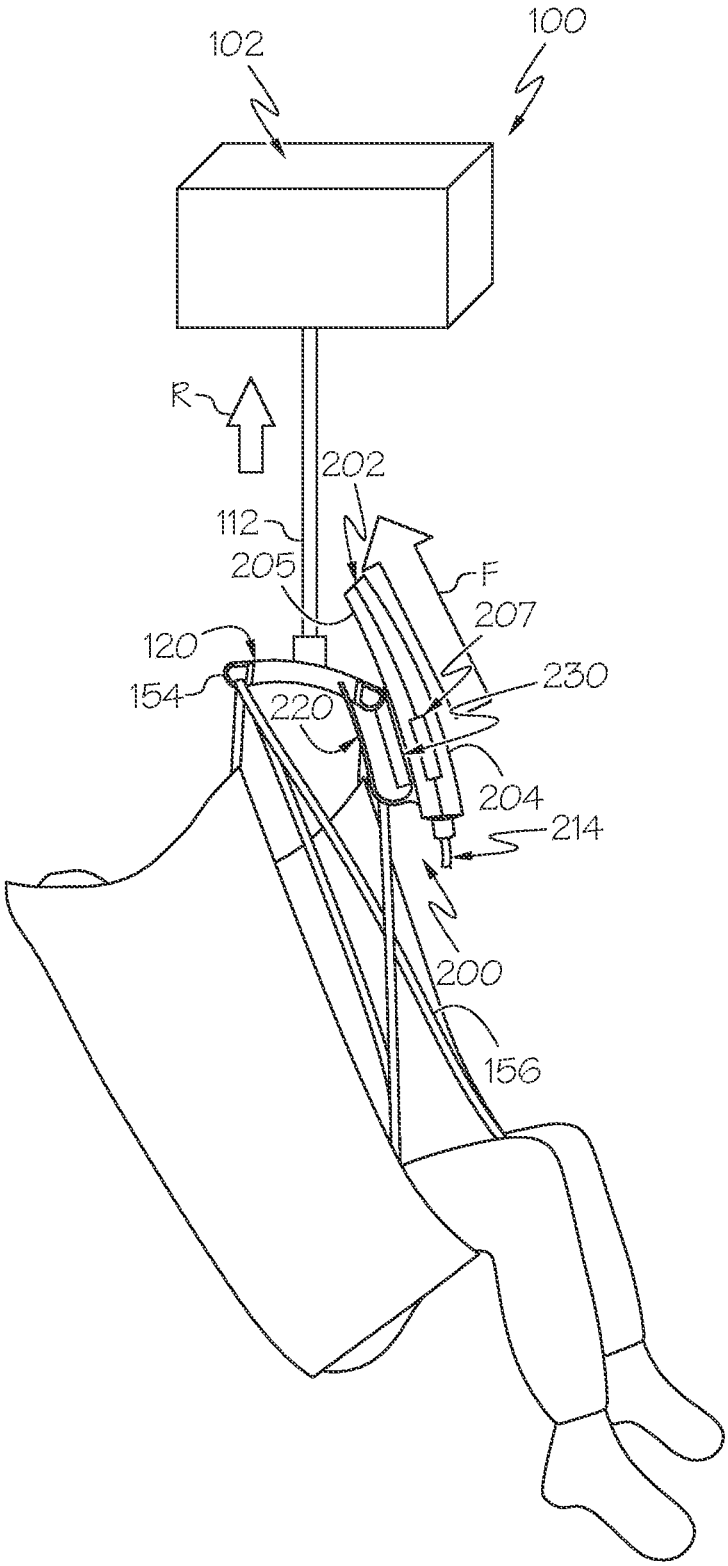
FIG. 9 schematically depicts a side perspective view of a subject seated in a lifting accessory and suspended from an overhead lift system according to one or more embodiments shown or described herein.
Figure 10:
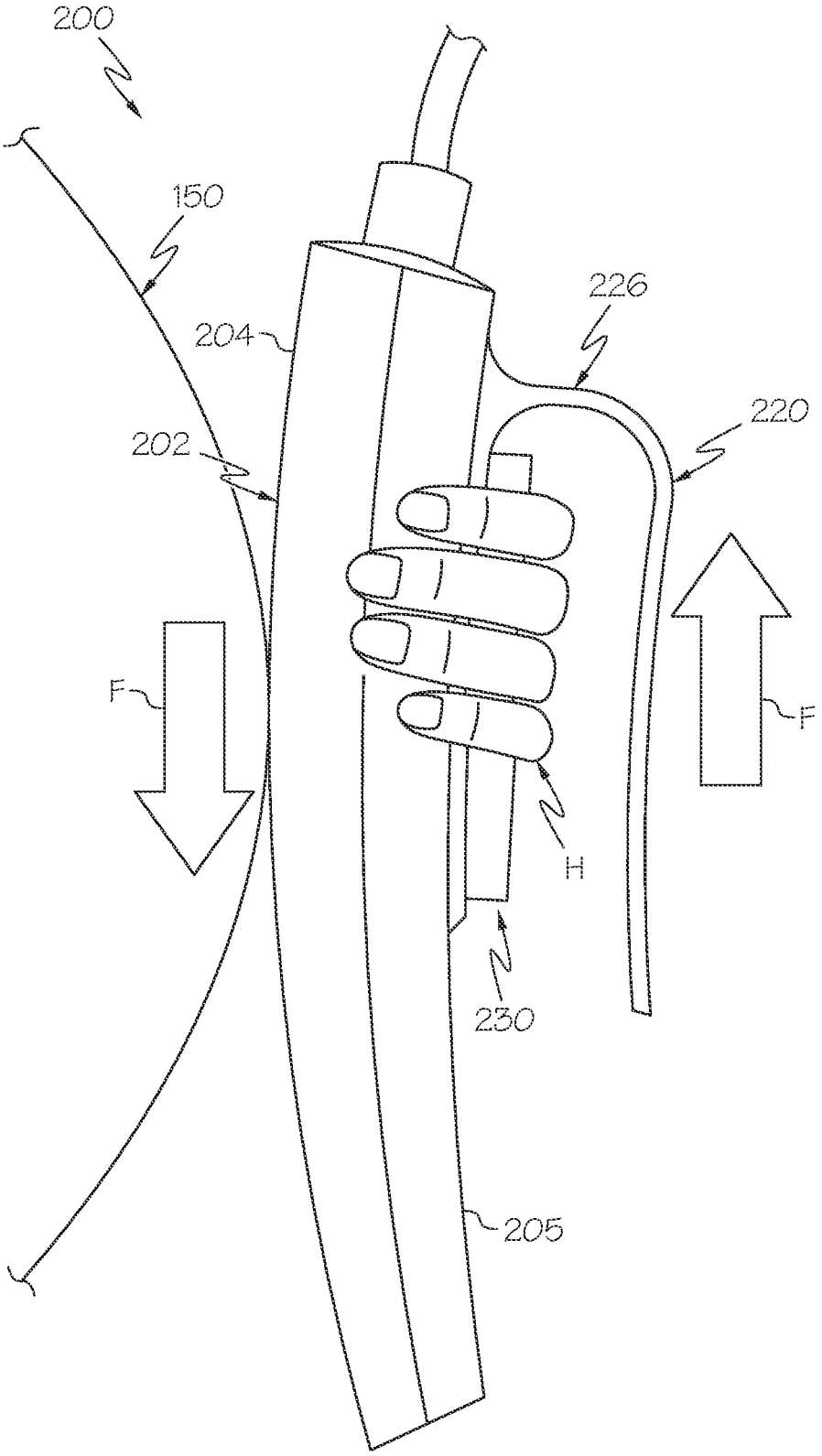
FIG. 10 schematically depicts a side view of a hand controller for an overhead lift system according to one or more embodiments shown or described herein.

Referring now to FIGS. 4 and 8-10, in some embodiments, a subject is placed in lifting accessory 150, which is secured to the sling bar 120 via strap members 156. With the subject secured within lifting accessory 150, a caregiver could then use hand controller 200 in a shear pressure mode to control the overhead lift unit 102 to raise the subject. A caregiver first arranges their hand H within the space formed by handle 220, with their hand H arranged over force sensor 230, as depicted in FIG. 10. The caregiver presses button 207 arranged on the body 202 of hand controller 200. Activation of button 207 deactivates input buttons 208 arranged on the front surface 204 of the hand controller 200 to prevent contradicting signals from being sent to the overhead lift unit 102 if input buttons 208 were accidently pressed during operation of the overhead lift system 100 in a pressure mode.

With button 207 pressed, the caregiver contacts the subject in the lift sling with the front surface 204 of hand controller 200. By contacting the subject with front surface 204 while the caregiver's hand H is positioned in the handle 220, a shear force F is applied to the body 202 of hand controller 200 through the hand H. This shear force is detected with force sensor 230.

Alternatively, in some embodiments, handle 220 could be secured to a hook or strap of lifting accessory 150, or sling bar 120 itself. Once the hand controller 200 is attached via handle 220 to the sling bar 120 or the lifting accessory 150, a caregiver could apply a shear force to the body 202 of the hand controller 200 by applying a shear force to any part of the body 202 or the handle 220. Force sensor 230 detects the shear force F applied through the body 202 or the handle 220 and outputs a signal 245 to control unit 250.

Once the force sensor 230 is activated by a shear force, a signal 245 is outputted to the control unit 250 indicative of the force. Simultaneously, the gyroscope 240, the accelerometer 242, or both, send output signals 241 and 243, respectively, to control unit 250. The output signals 241 and 243 indicate the orientation and direction of acceleration of the hand controller 200, in order to determine the direction of intended travel of the lift strap 112. Once the control unit 250 receives and processes the inputs from the force sensors 230, the gyroscope 240, and the accelerometer 242, control unit 250 outputs signal 255 to the motor 103 of the overhead lift unit 102 to either raise or lower lift strap 112 and at what speed.

As shown in FIG. 8, if the primary component of the force F applied to the subject is in a downward direction, as determined by the gyroscope 240 and the accelerometer 242, the lift strap 112 will be paid out by the motor 103 of the overhead lift unit 102, and the subject will be lowered in the direction indicated by arrow L. Similarly, as shown in FIG. 9, if the primary component of the force F applied to the subject is in an upward direction, as determined by the gyroscope 240 and the accelerometer 242, the lift strap 112 will be taken up by motor 103 of the overhead lift unit 102, and the subject will be raised in direction R.

Figure 11:
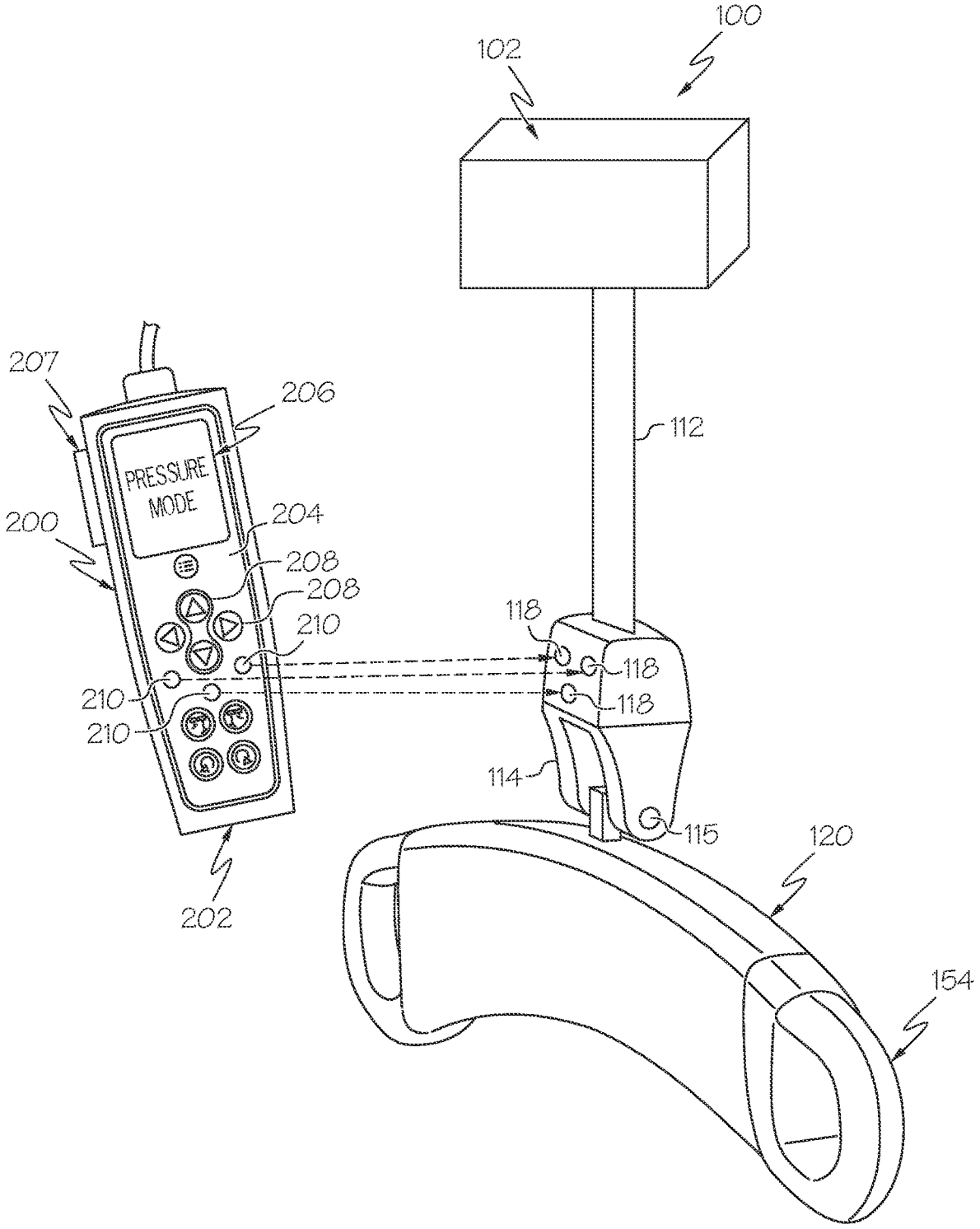
FIG. 11 schematically depicts a side perspective view of an overhead lift system according to one or more embodiments shown or described herein.
Figure 12:
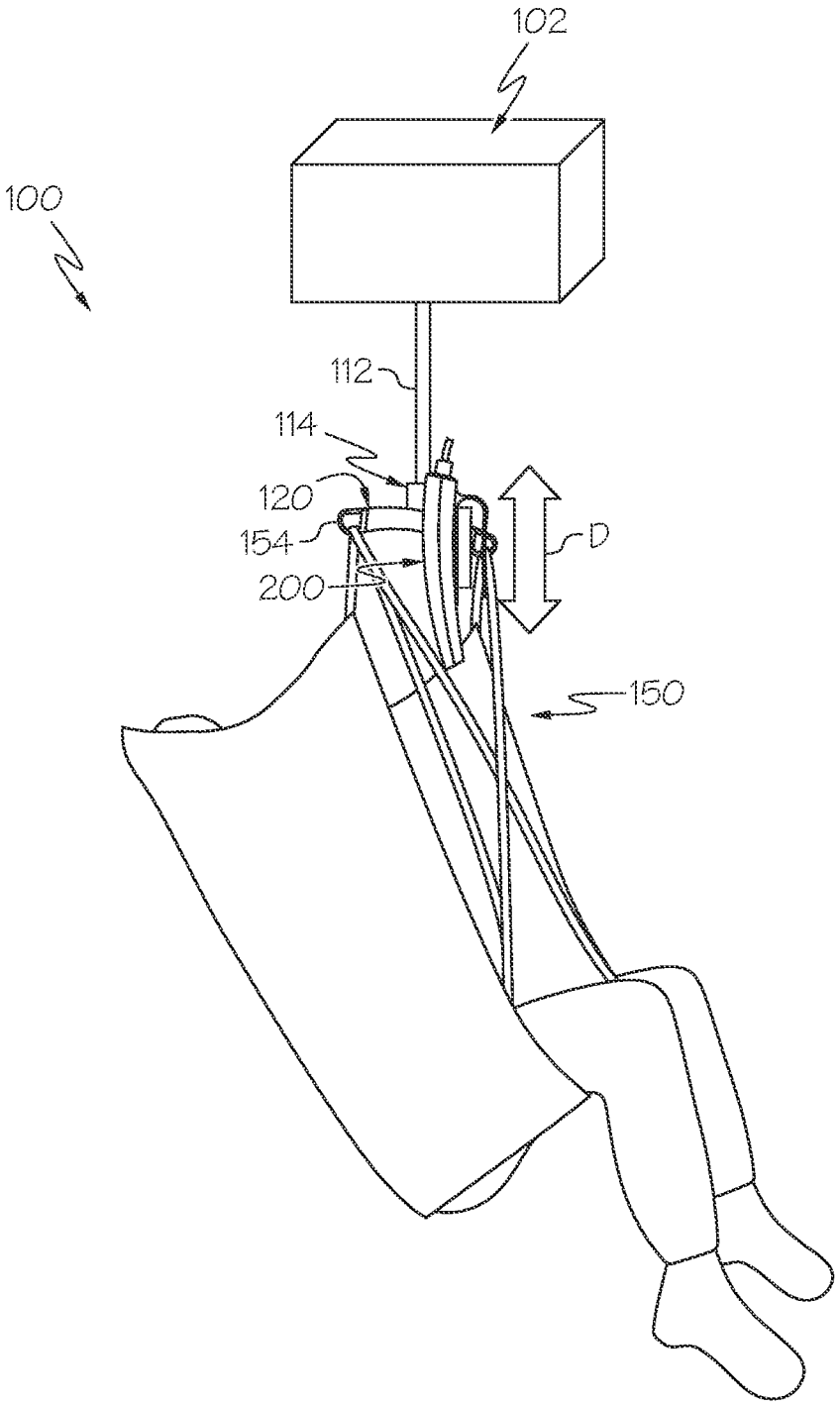
FIG. 12 schematically depicts a side perspective view of a subject seated in a lifting accessory and suspended from an overhead lift system according to one or more embodiments shown or described herein.

Referring now to FIGS. 4,11 and 12, in some embodiments, overhead lift system 100 could be operated in a pressure mode when hand controller 200 is operatively arranged on the quick-release link 114 of the lift strap 112. As described herein, quick-release link 114 includes securement interface 118, which corresponds to securement interface 210 of hand controller 200. In some embodiments, securement interface 118 and securement interface 210 can only be joined if the quick-release link 114 and the hand controller 200 are oriented in a securement orientation position. Due to the securement orientation position being a single orientation, there is no need for a gyroscope or accelerometer within hand controller 200 since the orientation of hand controller 200 is fixed once the quick-release link 114 and the hand controller 200 are coupled via securement interfaces 118 and 210. In some embodiments, securement interfaces 118 and 210 are magnetic. In some embodiments, the securement interfaces 118 and 210 are magnetic and electrical such that, once connected, a signal 246 is sent to the control unit 250 indicating that quick-release link 114 and hand controller 200 are coupled in the securement orientation position.

With the subject secured within lifting accessory 150, a caregiver may use the hand controller 200 in a shear pressure mode to control the overhead lift unit 102 to raise and/or lower the subject. A caregiver arranges their hand H within the space formed by handle 220, with their hand arranged over force sensor 230. In some embodiments, the caregiver presses button 207 arranged on body 202 of hand controller 200. Activation of button 207 deactivates input buttons 208 arranged on front surface 204 of hand controller 200 to prevent contradicting signals from being sent to the overhead lift unit 102 if input buttons 208 were accidently pressed during operation of the overhead lift system 100 in a pressure mode. With button 207 pressed, the caregiver slides his or her hand along the force sensor 230 in a raising or lowering motion, creating a shear force on force sensor 230. The shear force is applied since hand controller is rigidly coupled to quick-release link 114, and a caregiver's upward or downward motion would generate a shear force within body 202 of hand controller 200.

Once the force sensor 230 is activated by a shear force, signal 245 is outputted to control unit 250. Once control unit 250 receives the signal and processes the signal to determine the direction and magnitude of the applied shear force, control unit 250 outputs signal 255 to the overhead lift unit 102 to either raise or lower lift strap 112, as indicated by double arrow D, in the appropriate direction and speed.

Figure 13:
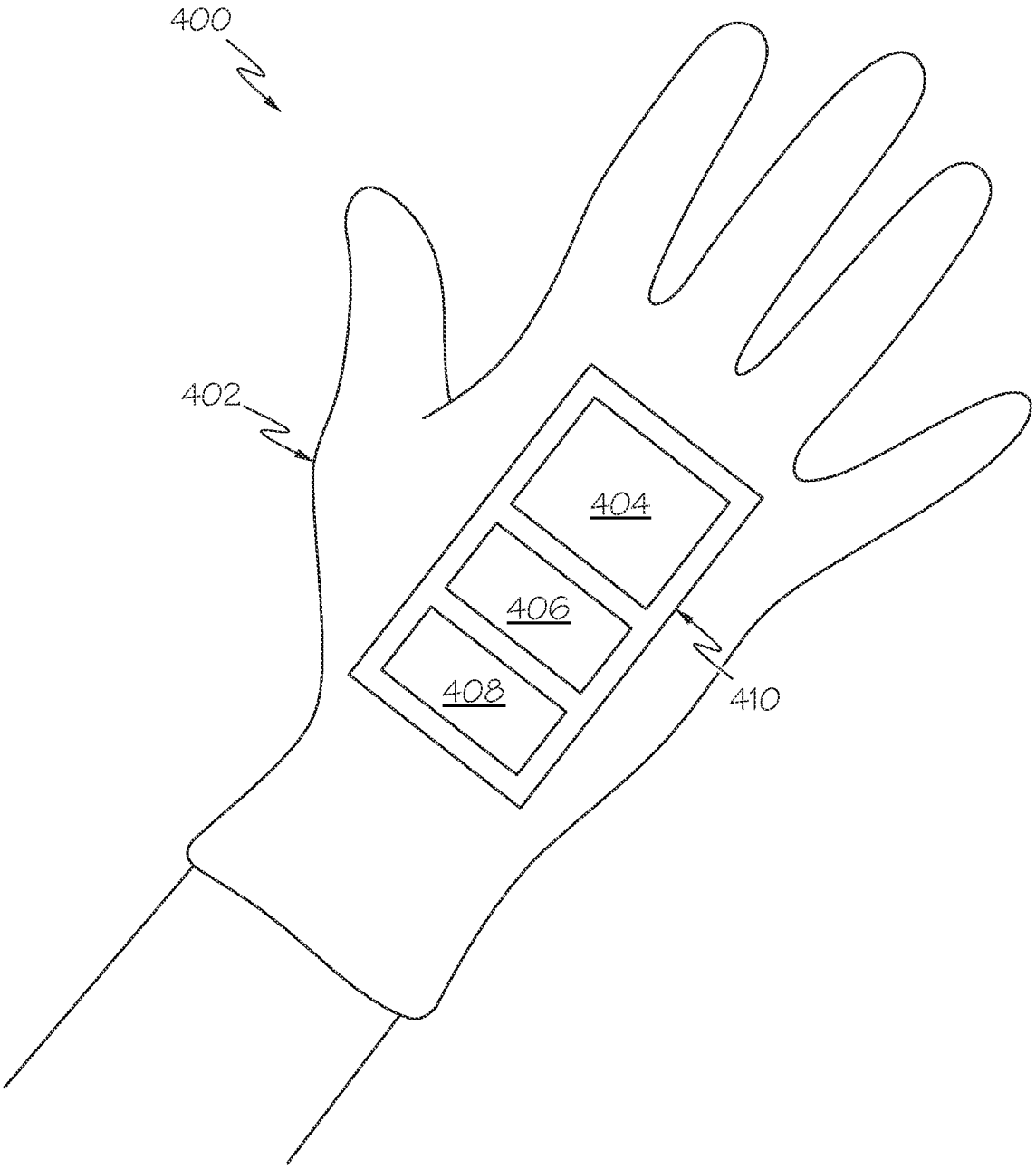
FIG. 13 schematically depicts a glove having illustrative internal components of the overhead lift system according to one or more embodiments shown or described herein.
Figure 14:
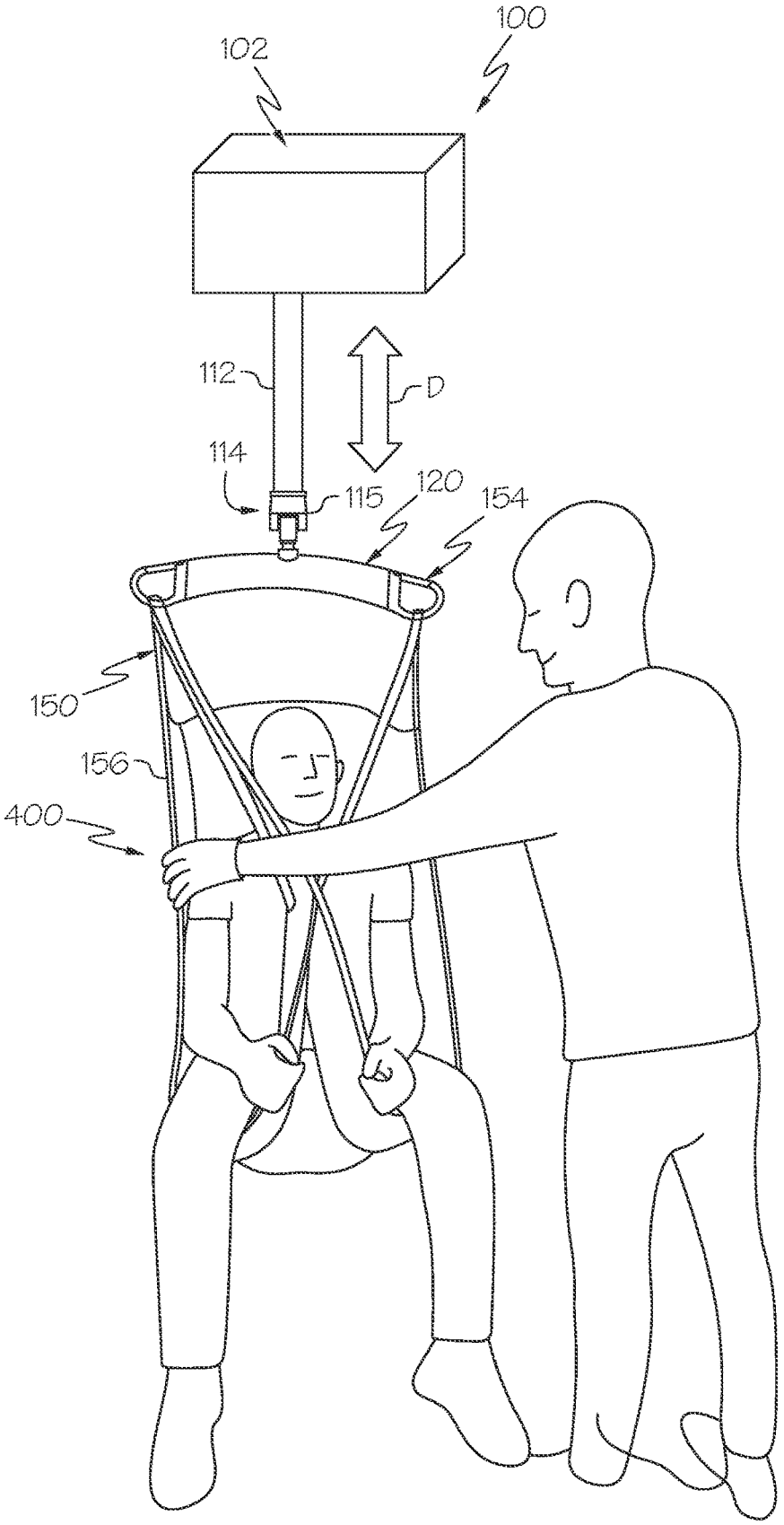
FIG. 14 schematically depicts a side perspective view of a subject seated in a lifting accessory and suspended from an overhead lift system according to one or more embodiments shown or described herein.

Referring now to FIGS. 13 and 14, in some embodiments, overhead lift system 100 includes a smart textile system 400, which includes glove 402, touch sensor 404, gyroscope 406, and accelerometer 408. Touch sensor 404, gyroscope 406, and accelerometer 408 are secured to glove 402 via mount 410. Touch sensor 404 is operatively arranged to interact with glove 402 such that when glove 402 contacts lifting accessory 150, a signal is sent to the control unit 250 indicating that a caregiver is contacting the lifting accessory 150, and a lifting procedure can begin. In some embodiments, the combination of glove 402 and touch sensor 404 can act as a failsafe mechanism to prevent a lifting procedure from happening unless a caregiver is physically touching the lifting accessory 150. Smart textile system 400 can be communicatively coupled to control unit 250 via a wired or wireless connection.

Additionally, in some embodiments, smart textile system 400 can replace hand controller 200. In order to perform a lifting procedure, a caregiver contacts the lifting accessory 150 with their hand wearing glove 402. This would indicate to overhead lift system 100 that a lifting procedure can be performed since the caregiver is in the correct location. Simultaneously, as the caregiver begins to move their hand wearing glove 402, gyroscope 406 and accelerometer 408 would output orientation and acceleration signals to control unit 250. Control unit 250 would process the input signals from gyroscope 406 and accelerometer 408, and output a control signal 255 to the motor of the overhead lift unit 102 to either raise or lower lift strap 112 in a direction indicated by double arrow D based on the intended direction of movement as determined from the gyroscope 406 and the accelerometer 408.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. An overhead lift system, comprising:
- a motor;
- a lift strap connected to the motor, wherein the motor is operable to raise and lower the lift strap;
- a hand controller communicatively connected to the motor, the hand controller comprising:
  - a body having a front surface and a back surface;
  - a handle arranged on the back surface of the body;
  - a force sensor operatively associated with the body and arranged between the back surface of the body and the handle such that force applied to the body is detected with the force sensor;
  - an orientation sensor arranged within the body, the orientation sensor determining an orientation of the hand controller;
  - input buttons arranged on the front surface of the body, the input buttons communicatively connected to the motor;
  - a button arranged on the body, wherein activation of the button deactivates the input buttons; and
  - a control unit communicatively connected with the motor, force sensor, and orientation sensor and comprising a processor, a memory storing a computer readable and executable instruction set which, when executed by the processor:
    - detects a force applied to the hand controller with the force sensor;
    - determines a direction of motion of the hand controller with the orientation sensor;
    - deactivates the input buttons if a pressure mode is activated, wherein the pressure mode is activated if at least one of the button arranged on the body is activated or the force applied to the hand controller is detected by the force sensor and a change in orientation of the hand controller is determined by the orientation sensor; and
    - provides a control signal to the motor to either raise or lower the lift strap based on the detected force and the determined orientation of the hand controller.

2. The overhead lift system of claim 1, wherein the orientation sensor comprises an accelerometer.

3. The overhead lift system of claim 1, wherein the orientation sensor comprises a gyroscope.

4. The overhead lift system of claim 1, wherein the force sensor is arranged on the handle arranged on the back surface of the body.

5. The overhead lift system of claim 4, wherein the force sensor detects a shear force applied to the hand controller.

6. The overhead lift system of claim 1, wherein the force sensor is arranged on the front surface of the body.

7. The overhead lift system of claim 1, further comprising an activation switch arranged on the hand controller, wherein the activation switch is activated to allow the motor to raise and lower the lift strap.

8. The overhead lift system of claim 1, wherein the force sensor detects a compressive force applied to the hand controller.

9. The overhead lift system of claim 1, wherein the force sensor detects a shear force applied to the hand controller.

10. The overhead lift system of claim 1, wherein a speed at which the motor raises or lowers the lift strap is proportional to the force detected by the force sensor.

11. An overhead lift system, comprising:
- a motor;
- a lift strap connected to the motor, wherein the motor is operable to raise and lower the lift strap;
- a mounting clip arranged on the distal end of the lift strap, the mounting clip comprising a first securement interface;
- a hand controller communicatively connected to the motor, the hand controller comprising:
  - a body having a front surface and a back surface;
  - a second securement interface on at least one of the front surface and the back surface, wherein the second securement interface is arranged to couple with the first securement interface in a secured orientation position;
  - a force sensor operatively associated with the body such that force applied to the body is detected with the force sensor;
  - an accelerometer arranged within the body, the accelerometer determining an acceleration of the hand controller;
  - a gyroscope arranged within the body, the gyroscope determining an orientation of the hand controller; and
  - a coupling sensor operatively associated with at least one of the first securement interface and the second securement interface; and
- a control unit communicatively connected with the motor, force sensor, the accelerometer, and the gyroscope and comprising a processor, a memory storing a computer readable and executable instruction set which, when executed by the processor:

detects the first securement interface coupled to the second securement interface in the secured orientation position with the coupling sensor;

detects a force applied to the hand controller with the force sensor;

determines an acceleration of the hand controller with the accelerometer;

determines an orientation of the hand controller with the gyroscope; and provides a control signal to the motor to either raise or lower the lift strap based on the detected force, the determined acceleration of the hand controller when the first securement interface is coupled to the second securement interface as detected by the coupling sensor, and the determined orientation of the hand controller.

12. The overhead lift system of claim 11, wherein the force sensor detects a shear force applied to the hand controller.

13. The overhead lift system of claim 11, wherein the force sensor is operatively arranged on the back surface of the hand controller.

14. The overhead lift system of claim 11, further comprising a handle arranged on the back surface of the hand controller.

15. The overhead lift system of claim 14, wherein the force sensor is operatively arranged on the handle of the hand controller.

16. The overhead lift system of claim 11, wherein a speed at which the motor raises or lowers the lift strap is proportional to the force detected by the force sensor.

17. An overhead lift system, comprising:

a motor;

a lift strap connected to the motor, wherein the motor is operable to raise or lower the lift strap;

a mounting clip arranged on the distal end of the lift strap, the mounting clip comprising a first securement interface;

a hand controller, communicatively connected to the motor and comprising: a body having a front surface and a back surface;

a second securement interface, wherein the second securement interface is arranged to couple with the first securement interface in a secured orientation position; and a force sensor operatively associated with the body such that force applied to the body is detected with the force sensor; and a coupling sensor operatively associated with at least one of the first securement interface and the second securement interface; and a control unit communicatively connected with the motor, the force sensor, and the coupling sensor and comprising a processor, a memory storing a computer readable and executable instruction set which, when executed by the processor:

detects the first securement interface coupled to the second securement interface in the secured orientation position with the coupling sensor;

detects a force applied to the lift strap with the force sensor; and provides a control signal to the motor to either raise or lower the lift strap based on the force applied to the lift strap when the first securement interface is coupled to the second securement interface as detected by the coupling sensor.

* * * * *